United States Patent [19]

Shaw et al.

[11] 4,136,380

[45] Jan. 23, 1979

[54] COUNTER TOP DISPLAY UNIT

[76] Inventors: Jerry Shaw, 50 W. Fairlawn Blvd.; Samuel G. Solitt, 2121 Brookshire Rd., both of Akron, Ohio 44313

[21] Appl. No.: 781,569

[22] Filed: Mar. 28, 1977

[51] Int. Cl.[2] ..... F21V 33/00; A47B 77/08

[52] U.S. Cl. ..... 362/145; 362/418; 312/223

[58] Field of Search ..... 362/97, 125, 127, 128, 362/132, 134, 142, 396, 133, 418, 145, 135, 136, 139, 430; 312/196, 223

[56] References Cited

U.S. PATENT DOCUMENTS

| | | | |
|---|---|---|---|
| 1,419,899 | 6/1922 | Beville | 362/132 |
| 1,460,684 | 7/1923 | Seaman | 362/127 X |
| 1,818,582 | 8/1931 | Rosacker | 362/396 X |
| 2,294,624 | 9/1942 | Miller | 362/413 X |
| 2,783,367 | 2/1957 | Locke | 362/396 |
| 2,810,820 | 10/1957 | Nelson | 362/132 |
| 2,939,946 | 6/1960 | Holderle et al. | 362/125 |
| 3,462,592 | 8/1969 | Schweich | 362/127 X |

*Primary Examiner*—William M. Shoop
*Assistant Examiner*—Peter S. Wong
*Attorney, Agent, or Firm*—Reese Taylor

[57] ABSTRACT

A counter top display unit is disclosed which is portable and suitable for utilization on the top of a display counter or other planar surface. The unit includes opposed triangular pedestals supporting an overhead canopy with the pedestals having display areas on at least one face thereof, and with the canopy containing light sources and overhanging the pedestals. The pedestals also contain adjustable attachment means on their rear faces suitable for adjustable attachment to the supporting member. Furthermore, the pedestals are adjustable along the longitudinal axis of the canopy so as to make the unit capable of use on planar surfaces having varying length dimensions.

5 Claims, 8 Drawing Figures

COUNTER TOP DISPLAY UNIT

BACKGROUND OF THE INVENTION

This invention relates, in general, to display devices for retail merchandising and relates in particular to units for the display of relatively small articles such as, for example, jewelry; such unit being capable of being portable and releasably mounted on existing planar surfaces such as counter tops.

DESCRIPTION OF THE PRIOR ART

In the retail merchandising field, it is important to display articles attractively to catch the attention of the customer. It is also, however, desirable to produce such display in an economical fashion utilizing a minimum of space. Furthermore, display flexibility is also a desirable characteristic.

In addition to conventional "built in" display units, Applicants are aware of a number of free standing display units suitable for the display and merchandising of a wide variety of products.

An example can be seen in Applicants' earlier U.S. Pat. No. 3,980,361 wherein an expandible display system for displaying small articles such as jewelry is disclosed having vertical supporting members and an overhanging canopy. Further examples may also be seen in the references cited in U.S. Pat. No. 3,980,361.

There are a number of other display units of this general nature in the prior art. However, none of them are units capable of being releasably secured to existing display cases, nor are they adjustable to conform to various sizes of supporting surfaces. Nor are the prior art devices known to Applicant capable of occupying and changing the character of what is otherwise empty, unused space, i.e., the space above the top of an existing display case.

SUMMARY OF THE INVENTION

Accordingly, it becomes an object of this invention to provide a display unit for small articles such as, but not limited to, jewelry which can be portable and moved from place to place.

It is a further object to provide a display unit which can be supported on a planar surface such as, for example, the top of an existing display case.

It is a further object of this invention to provide such a display unit with opposed upstanding support pedestals carrying an overhanging canopy on the tops thereof.

It is a further object of this invention to provide for adjustment of the pedestals along the longitudinal axis of the canopy to accommodate the unit to supporting surfaces of varying lengths.

It is a further object of the invention to provide means for attaching the display unit to the supporting unit and to provide for adjustment of the attaching means.

Accordingly, production of an improved display unit having the above noted characteristics becomes the principal object of this invention with other objects thereof becoming more apparent upon a reading of the following brief specification, considered and interpreted in view of the accompany drawings.

OF THE DRAWINGS

BRIEF DESCRIPTION OF THE PREFERRED EMBODIMENTS

Figure 1:
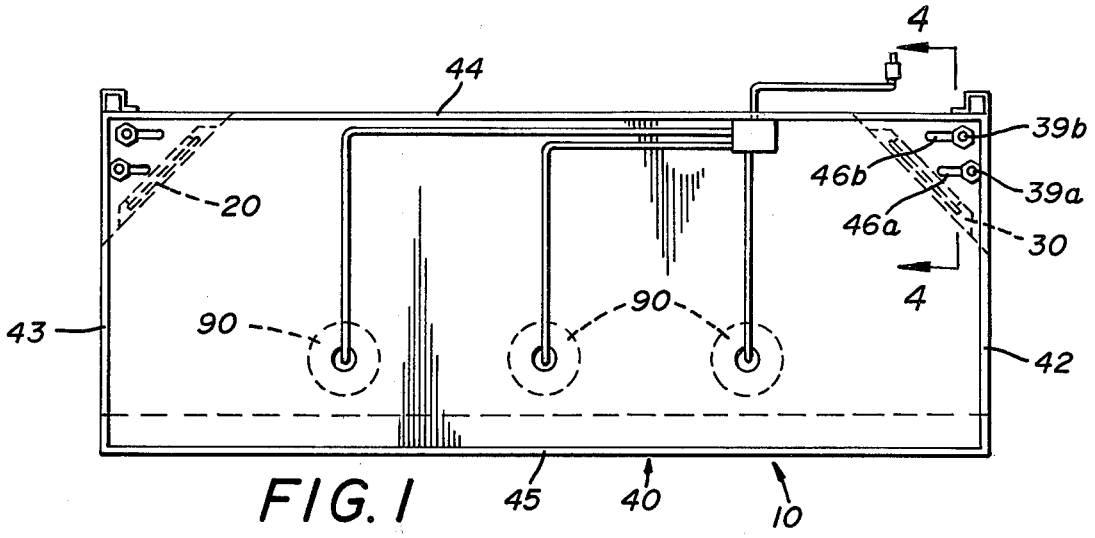
FIG. 1 is a top plan view of the improved display unit.
Figure 2:
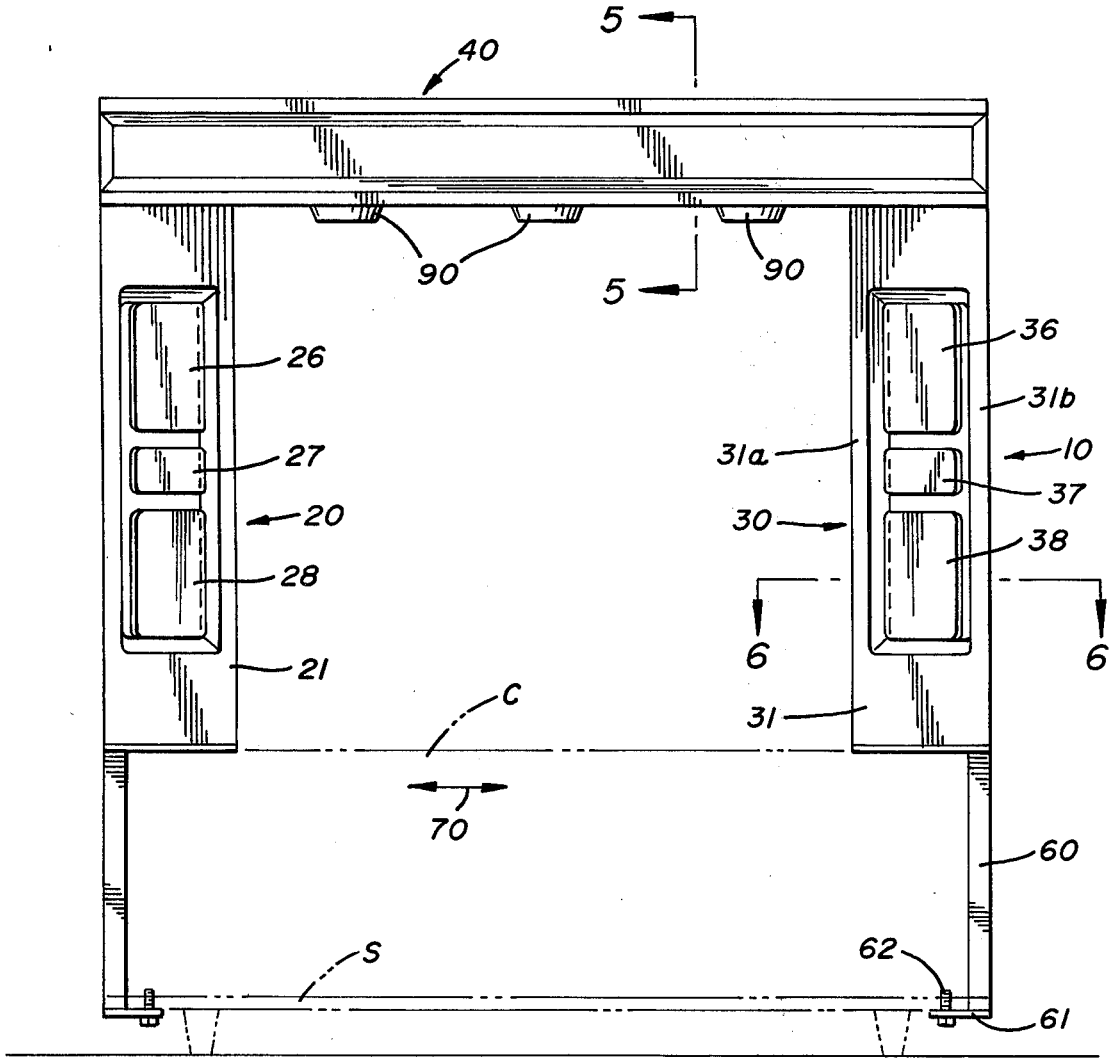
FIG. 2 is a front elevational view thereof.

Referring first to FIGS. 1 and 2, it will be noted that the improved display unit, generally indicated by the numeral 10, includes three main components. These components are pedestals 20 and 30 and a canopy or header 40 supported by the top ends of the pedestals 20 and 30.

Pedestals 20 and 30 being identical, only pedestal 30 will be described in detail; and in this regard, reference is had to FIGS. 2 and 6 wherein it will be noted that the pedestal 30 is generally triangular in cross sectional configuration consisting of a hypotenuse leg 31 and secondary legs 32 and 33 which join together in right angle disposition.

Leg 33, which is the outboard leg, has a decorative laminate 34 secured thereto by glueing, nailing or other suitable means for decorative purposes.

Hypotenuse leg 31 has opposed ends 31*a*, 31*b* and a reduced thickness central portion which receives a display housing 38*b* with a covering 38*a*.

If reference is had to FIG. 2, it will be noted that three such display housings 36, 37, and 38 are illustrated, although the precise number can be varied. Their purpose is, of course, to permit articles or pictures of the articles to be visually displayed in these areas. It should also be noted that, while leg 31 is shown as an essentially solid panel, it would be possible to provide an open leg with shelves spanning the distance from leg 34 to leg 35.

Leg 32 which is, in effect, the rear leg of the pedestal has a laminate 35 secured thereto, and a mounting bracket 50 which will be described in greater detail below is also secured thereto.

The canopy 40 is essentially an elongate box-like structure consisting of opposed end members 42 and 43, a rear member 44 and a forward member 45 capable of receiving advertising or other informational material. The unit also has a bottom panel 46; and it is understood that in the preferred form of the invention, the canopy unit is open at the top.

Mounted on bottom panel 46 are a plurality of lights 90, 90 which are preferably of the "eyeball" type or, in other words, adjustable so as to be directed, for example, toward the pedestals and the top of display case C. Also, in this regard, it has been found desirable to locate the lights 90, 90 toward the forward member 45 to reduce glare from the display case C when the unit is in place.

Figure 4:
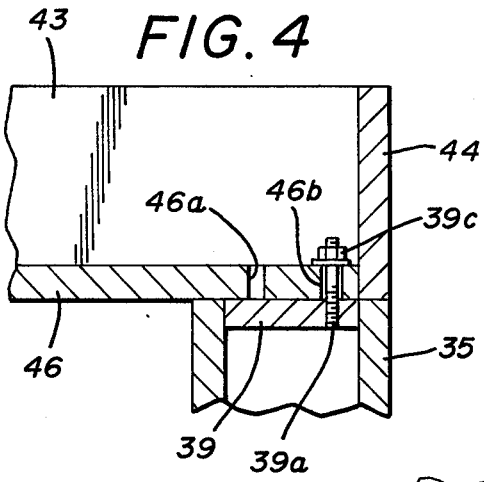
FIG. 4 is a sectional view taken along the line 4—4 of FIG. 1 and rotated 90°, showing the horizontal adjustment feature.
Figure 6:
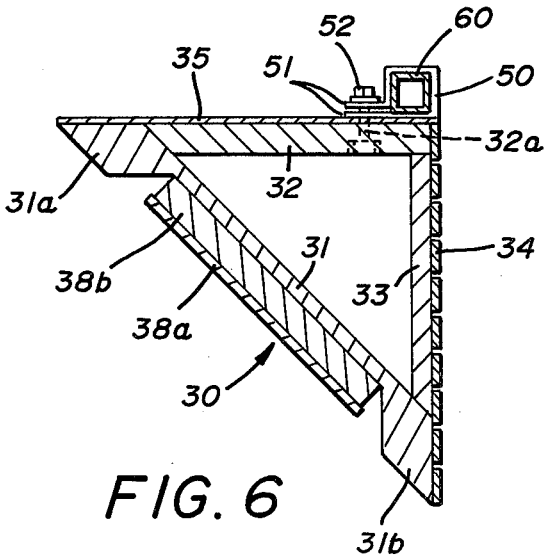
FIG. 6 is a sectional view of one of the pedestals taken along the line 6—6 of FIG. 2.

Referring next to FIGS. 4 and 6, it will be noted that pedestal 30 has a top plate 39; and the bottom panel 46 of the canopy unit 40 has elongate slots 46*a*, 46*b* therein with projecting studs 39*a* and 39*b* being secured to top plate 39 of the pedestal and projecting through the slots 46*a*, 46*b*.

The purpose of this construction is to accommodate the unit to varying lengths of supporting cases C. Thus, if the unit is shorter than standard length, it is simply necessary to loosen the nuts 39*c*, 39*c* and slide the studs 39*a* and 39*b* in the slots 46*a* and 46*b* along the longitudinal axis of the canopy 40 to permit adjustment. Once the proper adjustment has been made, the nuts 39*c*, 39*c* can simply be tightened down and the unit will be in place.

As illustrated, stud 39*a* is fixed in top plate 39 and receives nuts 39*c* on its projecting end. It is apparent, however, that this arrangement could be reversed if desired.

Also, and as noted above, only pedestal 30 is being described in detail since pedestal 20 is identical; and pedestal 20 also has a similar arrangement (see FIG. 1) so that the two pedestals can preferably be moved inward or outward in the direction of arrow 70 identical amounts so that the pedestals will by symmetrical with regard to the canopy for aesthetic purposes, as well as for purposes of balance.

Figure 3A:
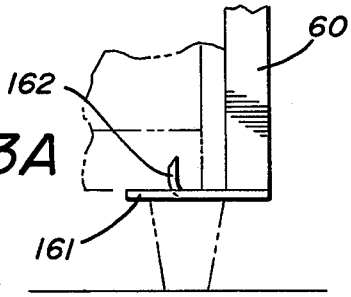
FIG. 3A is a partial elevational view showing modified means for attaching the display unit to a supporting structure.
Figure 3B:
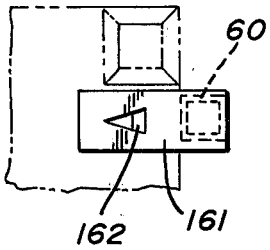
FIG. 3B is a bottom plan view of the modification of FIG. 3A.
Figure 3:
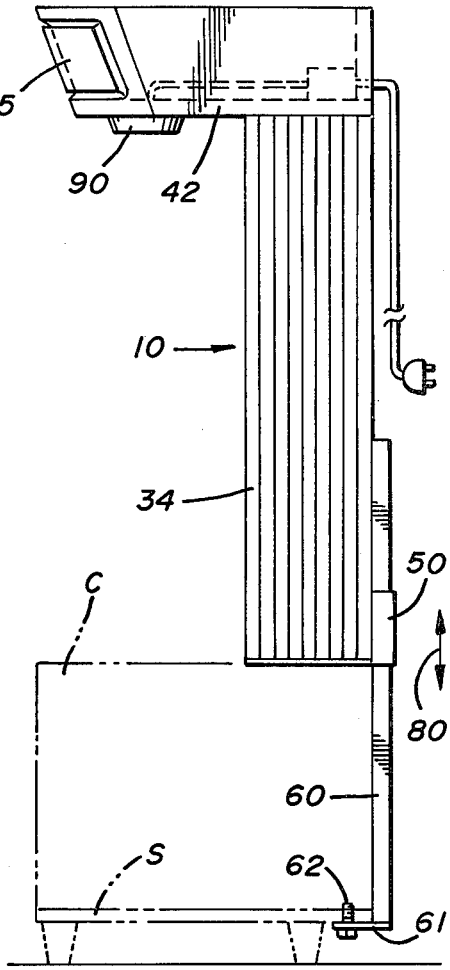
FIG. 3 is an end elevation thereof.
Figure 5:
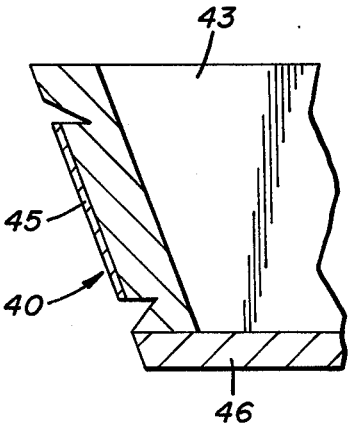
FIG. 5 is a sectional view of the canopy taken along the line 5—5 of FIG. 2.

Referring next then to FIGS. 3 and 6 for a description of the attachment means, it will be noted that a mounting bracket 50 is secured to the rear of each of the pedestals 20 and 30. This bracket has a pair of extending leaves 51, 51 which have a through aperture therein and are capable of receiving the bolt 52 which also protrudes into aperture 32*a* of wall 32 of the pedestal and is secured thereto.

The attachment bracket 50 is essentially a hollow or tubular metal member having a square cross-section and receives the attachment unit 60 in sliding relationship thereto. It is believed apparent, therefore, that the member 60 can be moved in a vertical direction (see arrow 80) following which, when the desired movement has taken place, the nut 52 is tightened down to hold the member 60 in its proper position.

The opposed end of the attachment member 60 has a foot 61 projecting therefrom at substantially right angles which is appropriately apertured and which is capable of receiving a screw 62 which can be screwed into the bottom of the shelf S of the supporting base C.

In the illustration (see FIG. 3), this foot 61 is shown secured to a shelf S at the bottom of the case C. However, it could be secured to any suitable securing place along the heighth of the case C with the adjustment bracket 50 permitting suitable movement ot accommodate varying heights of cases C.

FIGS. 3A and 3B show a modified attachment means wherein foot 161 has a barb 163 struck therefrom. In instances where access to shelf S is restricted, it is believed that this barb can engage the shelf by tilting the unit to the right of FIG. 3, for example, and then bringing it to the vertical position, whereby the barb 163 will be forced into shelf S which will normally be wooden.

Accordingly then, it has been disclosed how a new and improved display device can be provided which is portable and which is suitable for attachment to and mounting on any number of supporting surfaces such as, for example, a display case C.

Not only is the device portable and capable of being received on these units, but it is adjustable to accommodate for varying lengths of supporting units. Furthermore, it is capable of being attached to the unit in a releasable fashion so that it can be securely placed on the supporting member with no fear of tipping or displacement, but can be readily removed therefrom if desired.

Furthermore, a unit of this type is capable of effectively utilizing the space above the existing counter or display case which would otherwise be vacant. Such a display unit will also serve to focus the customer's attention to a specific area of the store.

It is also possible to utilize a series of these units each promoting a different product and creating readily discernable merchandising areas for specific products while being architecturally compatible.

Accordingly, while a full and complete description of the invention has been set forth in accordance with the dictates of the Patent Statutes, it should be understood that modifications can be resorted to without departing from the spirit hereof or the scope of the appended claims.

Thus, it should be noted that while jewelry has been referred to as one of the articles which can be displayed in connection with a device of this type, the device is definitely not intended to be so limited and, indeed, has utility with a wide variety of merchandise.

Also, while two slots and two studs are illustrated at the point of connection of each pedestal 20, 30 and canopy 40, more or less can be utilized so long as stability of the assembled unit is maintained.

Furthermore, while three lights 90 are illustrated, either more or less could be employed, as desired.

What is claimed is:

1. A display unit for use on a supporting counter, comprising:

(A) opposed pedestals each having top and bottom ends and display surfaces disposed intermediate said ends;

(B) an elongate, box-like canopy having a planar bottom panel;

(C) said top ends of said pedestals being attached to said bottom panel of said canopy adjacent its ends;

(D) said bottom ends of said pedestals being supported on the top of the supporting counter;

(E) attachment means carried by each of said pedestals for releasable engagement with the supporting counter;

(F) a top plate received on the top ends of each of said pedestals;

(G) said bottom panel of said canopy having at least one elongate slot therein extending along the longitudinal axis thereof and disposed adjacent each of its opposed ends; and (H) at least one threaded stud carried by each of said top plates and extending through said slots in said bottom panel of said canopy.

2. The display unit of claim 1 wherein said top ends of said pedestals are releasably attached to said bottom panel of said canopy for movement along the longitudinal axis thereof.

3. The display unit of claim 1 wherein said attachment means include:

(A) a mounting bracket secured to each of said panels behind said display surfaces; and (B) elongate attachment members each having one end received within one said bracket and movable therein and its opposed end releasably secured to the counter adjacent its bottom.

4. The display unit of claim 1 wherein said canopy projects beyond said display surfaces; and at least one light is carried by said canopy on the projecting portion thereof.

5. The display unit of claim 3 wherein said attachment members include normally projecting extensions on their opposed ends.

* * * * *